US005121304A

United States Patent [19]

Hall et al.

[11] Patent Number: 5,121,304

[45] Date of Patent: Jun. 9, 1992

[54] VEHICLE LAMP

[75] Inventors: Rolland B. Hall, Keene; John A. Bergin, Hancock, both of N.H.

[73] Assignee: GTE Products Corporation, Danvers, Mass.

[21] Appl. No.: 597,269

[22] Filed: Oct. 15, 1990

[51] Int. Cl.[5] ..... F21V 15/04

[52] U.S. Cl. ..... 362/61; 362/226; 362/297; 439/593

[58] Field of Search ..... 362/61, 226, 249, 83.3, 362/267; 439/56, 602, 611, 617, 619, 593

[56] References Cited

U.S. PATENT DOCUMENTS

| | | | |
|---|---|---|---|
| 3,339,172 | 8/1967 | Heath | 439/593 |
| 3,980,375 | 9/1976 | LaMarche | 439/593 |
| 4,528,619 | 7/1985 | Dolan et al. | 362/61 |
| 4,609,977 | 9/1986 | Eckhardt et al. | 362/61 |
| 4,634,920 | 1/1987 | Rijckaert et al. | 362/255 |
| 4,674,017 | 6/1987 | Bradley et al. | 362/61 |
| 4,814,959 | 3/1989 | Chakrabarti et al. | 362/61 |
| 4,868,722 | 9/1989 | Haraden | 362/226 |
| 4,870,546 | 9/1989 | Hammerl et al. | 362/226 |
| 4,890,202 | 12/1989 | Blanche | 362/226 |

FOREIGN PATENT DOCUMENTS

| | | | |
|---|---|---|---|
| 193997 | 9/1986 | United Kingdom | 362/35 |

*Primary Examiner*—Stephen F. Husar
*Assistant Examiner*—Y. Quach
*Attorney, Agent, or Firm*—William F. Meyer

[57] ABSTRACT

A vehicle lamp having a lamp capsule held in a holder with electric leads protruding into a base where a pressure arm holds the leads against connection lugs, in addition to the leads being welded to the connection lugs. The lugs then extend through the base to be exposed for connection in a connector receptacle end.

17 Claims, 4 Drawing Sheets

VEHICLE LAMP

TECHNICAL FIELD

The invention relates to vehicle lamps and particularly to capsule type vehicle lamp assemblies. More particularly the invention is concerned with a pressure arm to make a second secure contact point between the lamp leads and the connection lugs in a vehicle lamp assemble.

BACKGROUND ART

Tail lights, and signal lights have small bulbs with socket connections for coupling to a wire end power source. While there has been a constant drive to make the bulb coupling inexpensive, there has been a conflicting drive to make the coupling at least adequately if not completely water, salt, and vibration resistant. The most common taillight bulb is probably the bayonet type lamp, where the bulb base includes exterior contacts, and latches to couple with spring loaded contacts in a wire end socket. The bulb design is simple, and inexpensive, but total lamp function depends on the quality of the wire end socket provided by the automobile manufacturer. Unfortunately, the wire end sockets frequently have been equally simple. The wire end couplings may be bent, or twisted; or water, salt or dirt filled. The soldered, or clipped wire connections may also separate. The contacts corrode, and the spring contacts become intermittent. There are then lighting failures while the bulb is still good.

There is a trend to improve the taillight and marker light couplings, so the only possible lighting failure, is an actual failure of the lamp filament. The better couplings need strong matings with the wire end connector, and the lamp base. A need then exists for the lamp base side of the coupling to be improved to support such a strong mating. There is a further need for a strong coupling between the lamp leads, and the base coupling that can endure the extreme temperature, and environmental stresses that exist over the life of a vehicle.

DISCLOSURE OF THE INVENTION

A vehicle lamp may be formed with a capsule having an electrically powered light source, a light transmissive envelope, and a two or more protruding electrical leads. A holder having a capsule receptacle, and lug supports to assist in lug support, holds the capsule. Two or more connection lugs, at least one having a first coupling end supported in part by the holder, at least one contact point making a contact with one of the leads and an exposed connector end are supported in a combination of the holder and a base. The base coupled to the holder is formed with an included pressure arm pressing at least one lead against the at least one adjacent lug to preserve electrical contact between the lead and the lug.

BEST MODE FOR CARRYING OUT THE INVENTION

Figure 1:
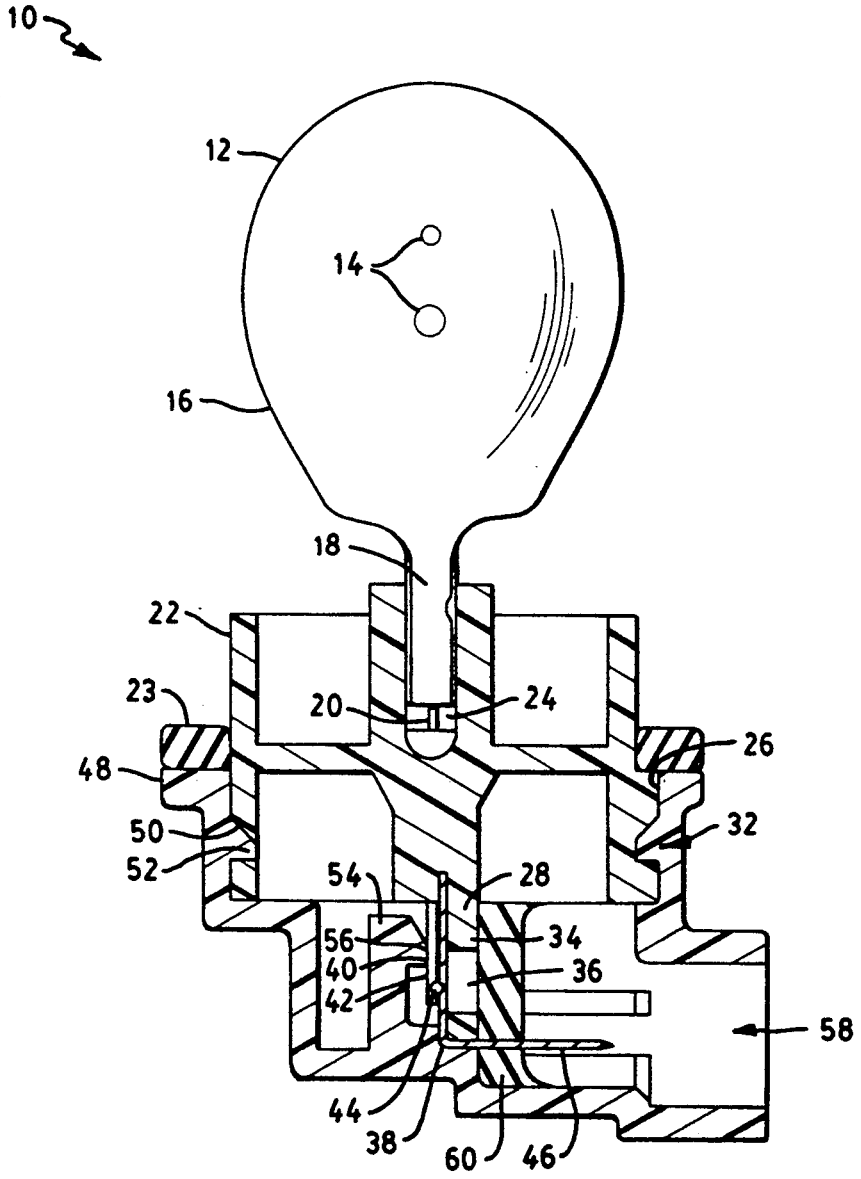
FIG. 1 shows an axial, cross sectional view, perpendicular to the lamp filament, of a preferred embodiment of a vehicle lamp.
Figure 2:
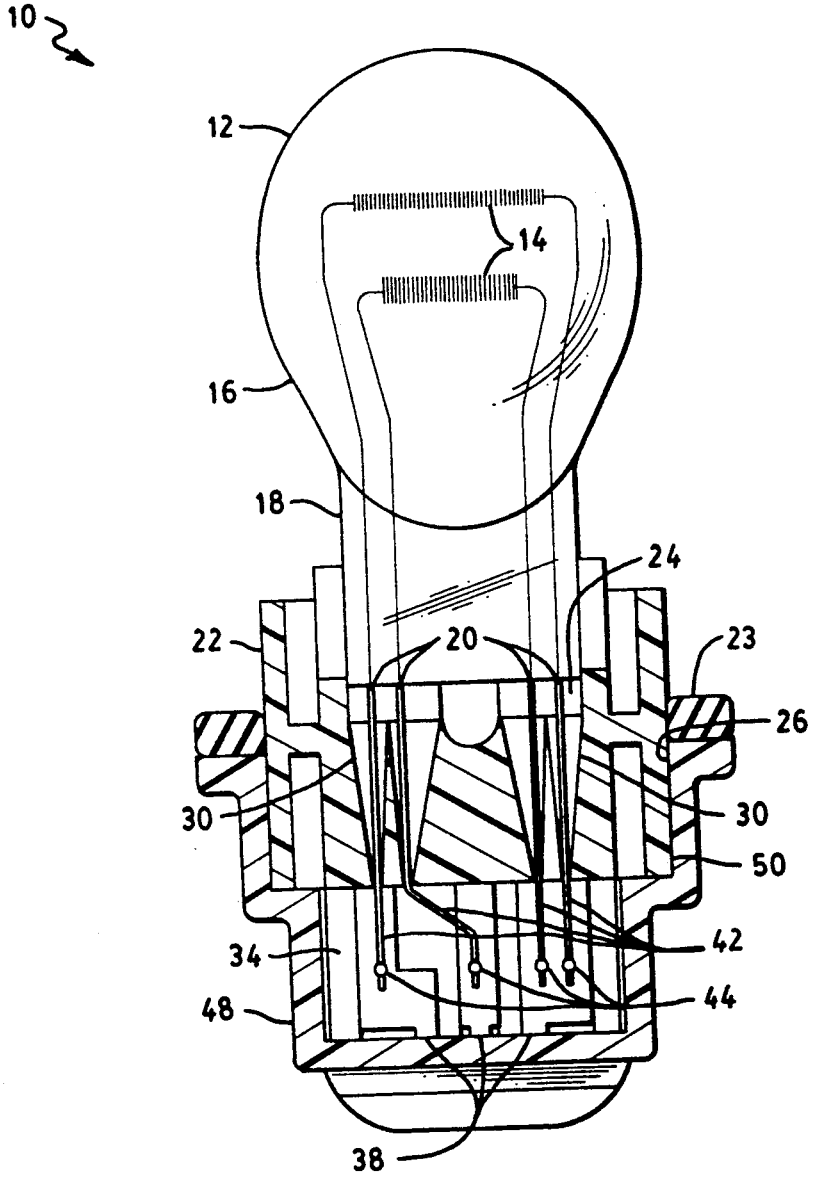
FIG. 2 shows an axial, cross sectional view, parallel to the lamp filament, of a preferred embodiment of a vehicle lamp.
Figure 3:
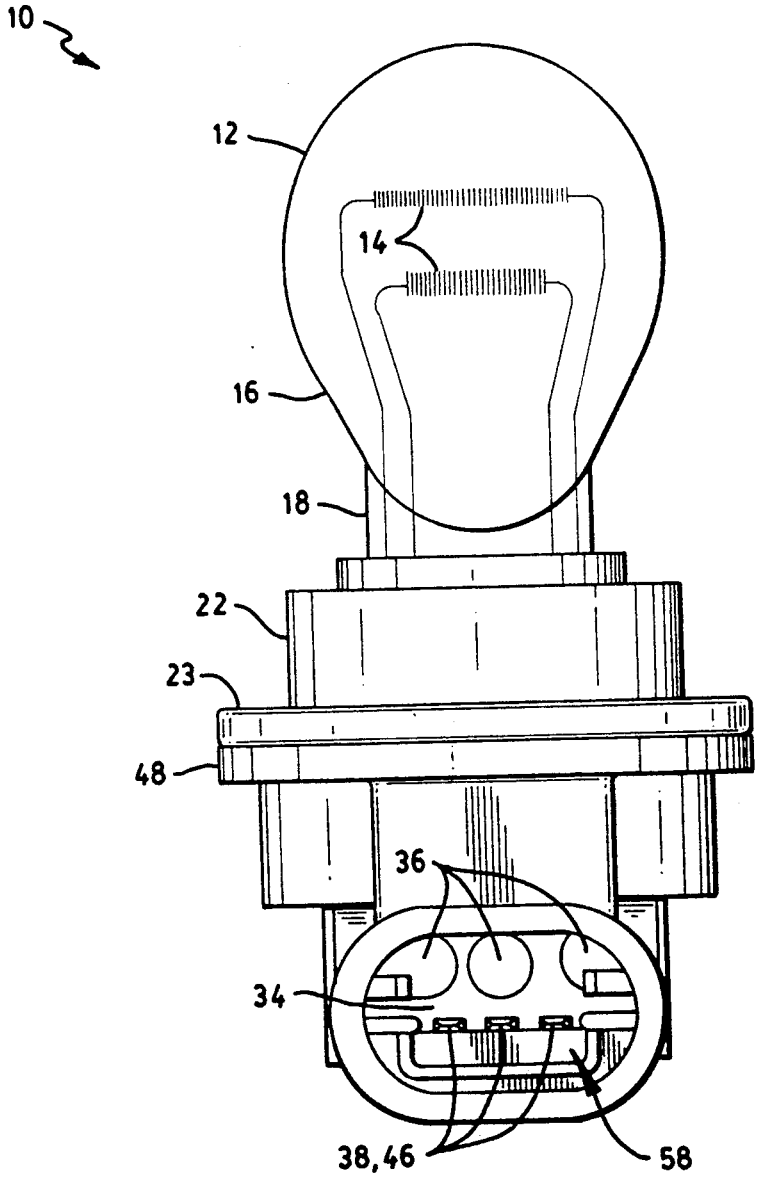
FIG. 3 shows a connector end view, parallel to the lamp filament, of a preferred embodiment of a vehicle lamp.
Figure 4:
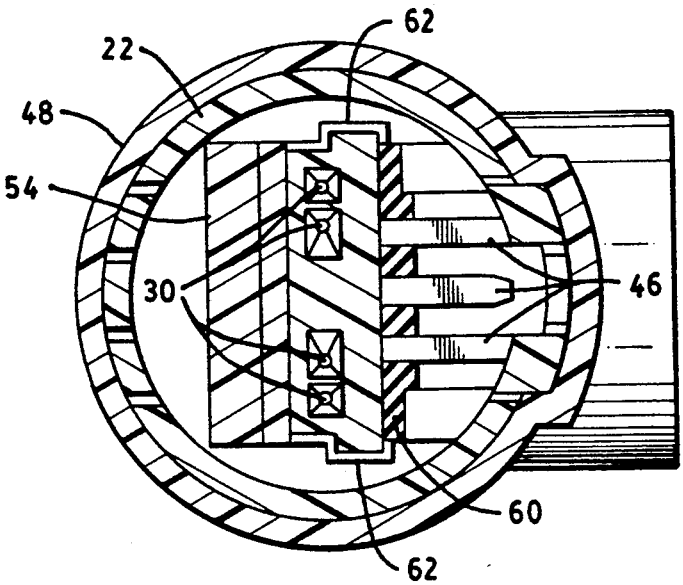
FIG. 4 shows a top, cross sectional view, transverse to the lamp axis, through the base above the connector ends of the lamp lugs of a preferred embodiment of a vehicle lamp.
Figure 5:
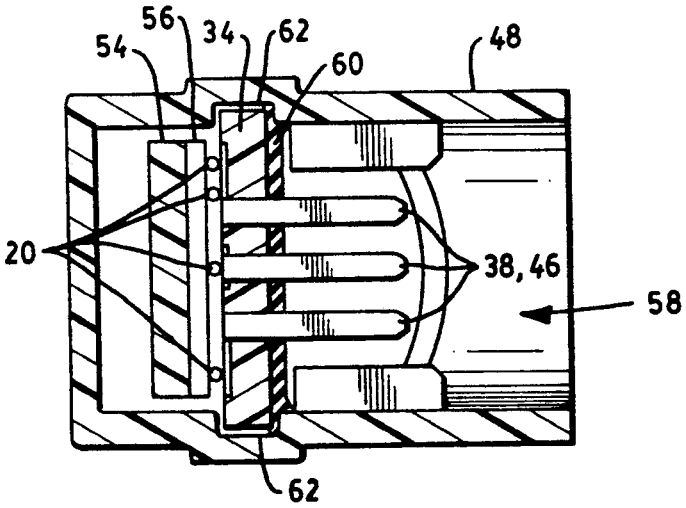
FIG. 5 shows a bottom cross sectional view, transverse to the lamp axis, through the base to be adjacent the connector ends of the lamp lugs of a preferred embodiment of a vehicle lamp.

FIG. 1 shows a cross sectional view of a preferred embodiment of a vehicle lamp. The vehicle lamp is assembled from a lamp capsule 12, a capsule holder 22, two or more connection lugs 38, and a base 48.

The capsule 12 has an electrically powered light source 14 enclosed in a light transmissive envelope 16 with a seal end 18. Protruding from the seal end 18 are two or more electrical leads 20. The preferred light source 14 is an incandescent. The light transmissive envelope 16 may be made of quartz or glass as is appropriate for the lamp chemistry and temperature of lamp operation. Applicant prefers a glass envelope 16 for use with a tungsten filament lamp, for example a 3156 or 3157 type lamp. The preferred envelope 16 has a pear shape with a flattened press seal end 18. Protruding from the capsule 12 in the seal end 18 are two or more electrical leads 20. Sealed through the envelope 16 in the seal end 18, the two or more electrical leads 20, protrude and extend as wire leads for electrical connection.

The lamp capsule 12 is held along the seal end 18 by the holder 22. The holder 22 may be a molded plastic body having a capsule receptacle 24, a holder coupling surface 26, and two or more lug couplings 28. The preferred holder 22 is made from an electrically insulating, slightly flexible material such as a plastic, or a filled plastic material. The preferred capsule receptacle 24 has a cavity portion with side walls complementary at least in part with the surface of the seal end 18. The seal end 18 may then be inserted in the receptacle 24 cavity to be held in close relation to the holder 22. The capsule receptacle 24 allows the leads 20 to pass around or through the holder 22 for connection. The leads 20 in the preferred holder 22 pass into the holder body, and emerge near the lug couplings 28 by means of through passages 30. The holder 22 also includes a holder coupling surface 26. The holder coupling surface 26 provides one side of a coupling made between the holder 22 and the base 48. The preferred holder coupling surface 26 has a continuous face encircling the leads 20 whereby an environmentally resistant seal may be made between the holder 22 and base 48 to protect the leads 20. In the preferred embodiment, the holder coupling surface 26 has an exterior facing cylindrical section with two, or more small rectangular windows 32. The preferred two windows 32 are positioned diametrically along the holder coupling surface 26.

The holder 22 also includes one or more lug couplings 28. The lug couplings 28 allow first ends 40 of the lugs 38 to be securely held by the holder 22. In the preferred embodiment, the lug couplings 28 include a lug wall 34 with one or more passages through the lug wall 34. The lug wall 34 may brace one side of the lugs 38. By way of example holder 22 is shown as a generally cylindrical piece with a diametric wall centered in the cylinder. Mounted on the diametric wall is an axially open, split wall box forming a clipping receptacle that couples with the press seal of the envelope. On the opposite side of the diametric wall is an axially projecting lug wall with two steps of elevation. Through passages extend from the split wall box forming the capsule receptacle, to the step region between the two lug wall elevations. The lug wall includes a through passage to a welding contact. Two small, diametrically opposed windows are formed in the exterior cylindrical wall.

The holder 22 supports a first end 40 of at least one lug, but preferably supports first ends 40 of all the lugs 38. Along the length of a preferred lug is a pressure contact point 42, and a weld point 44. The pressure contact point 42 may be any clean metal surface adjacent a length of one of the lamp leads 20. In the preferred embodiment, the lugs 38 are clean, flat brass right angles. One side of the right angle is inserted in the holder lug coupling 28, and runs parallel with a length of one of the leads 20. Transverse pressure on the lead may press the lead into electrical connection with the lug 38. Also along the length of the lug 38 is a weld point 44. The weld point 44 may be a special mounded surface formed on the lug 38, but in the preferred embodiment, a clean metal surface, adjacent the lead has been found to be sufficient. The weld point 44 in the preferred embodiment is opposite the lug wall passage 36. During assembly, a weld contact may then pass through the lug wall passage 36 to contact one surface of the lug 38. An opposite weld contact may similarly contact the adjacent lead 20, pressing the lead 20 towards the lug 38 and the first weld point 44. A pressurized weld may then be made between the lead 20 and the lug 38 at the weld point 44. The lug 38 further includes an exteriorly facing connector end 46. In the preferred embodiment, the lug connector end 46 is a flat blade typical of plug type connectors.

The holder 22 is held by the base 48. The base 48 has a base coupling surface 50, a pressure arm 54, and a connector receptacle 58. The preferred base 48 is made from an electrically insulating, slightly flexible material such as a plastic, or a filled plastic. The holder coupling surface 26 is designed to firmly mate with the base coupling surface 50. By forming one with an external facing surface, and the other with at least a partially complimentary internally facing surface, the two may be joined in a tight fitting relation that seals the internal facing portions of the holder 22 and base 48. In the preferred embodiment, the base 48 has an internally facing cylindrical surface with two small, rectangular teeth 52. The windows 32 in the receive over teeth 52 in the base, thereby positioning and holding the holder 22 and base 48 together. An unseparable coupling may then be made.

The base 48 further includes a pressure arm 54 made of a slightly flexible, insulating material. The pressure arm 54 is positioned to contact at least one of the leads 20 adjacent the respective pressure contact point 42 of a respective lug 38. The pressure arm 54 then presses the lead 20 against the lug 38 to make a second electrical connection. The preferred pressure arm 54 is an internally free wall with a rib 56 extending along an edge of the wall end. The pressure arm 54 is positioned to closely parallel the area where the leads 20 and lugs 38 are stationed when the holder 22 is coupled to the base 48. The rib 56 of the pressure arm 54 then contacts at least one, and preferably all of the leads 20 to force then against the adjacent, respective lugs 38 to form pressure contacts between the leads 20 and adjacent lugs 38. In the preferred embodiment, the base 48 further includes end slots 62 adjacent the ends of the lug wall 34.

The lug wall 34 may brace the lugs 38. The base 48 further includes a connector receptacle 58. The exposed connector ends 46 are surrounded in and protected by the connector receptacle 58, which may further provide a guide for a wire end connector to mate with the lugs 38. In one embodiment, the region between the lugs 38 and the base 48 in the connector receptacle 58 is filled with a potting material 60. The potting material 60 seals the area to prevent water, and other materials from entering the internal volume between the holder and base. Potting is an additional cost, and is felt to be unnecessary, provided the wire end coupling makes a water resistant coupling to the connector receptacle 58. The preferred embodiment, is then to use no potting if possible. The connector receptacle 58 may include guide features to insure proper orientation of the connector receptacle 58 and an inserted wire end or similar connector providing electrical power. The holder 22, base 48 or both may further include keying, locking features or sealing features as are generally known to enable secure coupling between the holder 22 and base 48 combination and a lamp, or vehicle housing. In one embodiment, an exterior shoulder is formed on the holder 22 adjacent the seam with the base 48. A ring seal 23 is positioned along the shoulder to be pinned into the seam area when the holder and base are locked into a lamp reflector. By way of example base 48 is shown generally as a single plastic body with a cylindrical end piece to mate with a holder, and at right angles, an oval piece to mate with a connector.

The vehicle lamp is assembled by first inserting the lugs 38 into the holder 22. The lamp leads 20 are then threaded through passages in the holder 22, and the seal end 18 of the capsule 12 is clipped into the split box receptacle end of the holder 22. The capsule 12 is then firmly coupled to the holder 22 with the leads 20 extending through the holder 22 to lie adjacent the flat faces of the lugs 38. The leads 20 and lugs 38 are then welded together by pressing the leads 20 on one side with a welding contact to force the lead 20 against the lug 38. Similarly, a second weld contact extends through the lug wall passage 36 to contact a back side of the lug 38. The lead and lug are then forced together during welding. The capsule 12, holder 22 and lug assembly is then clipped into the base 48 to mate the holder coupling surface 26 and base coupling surface 50. The windows 32 receive, locate and hold the teeth 52 to make a permanent, properly oriented coupling. At the same time the pressure arm 54 meets and presses the exposed portions of the leads 20 against the pressure connection point 42 on the lugs 38 which are in turn braced by the lug wall 34 thereby forming a second contact between the leads 20 and lugs 38. The right angle corners of the lugs 38 are positioned adjacent the foot of the free wall with the transverse, ends of the lug wall 34 positioned in the lug wall slots 62 formed in the base. The leads 20 and lugs 38 are then welded in contact, and held in a pressure contact. The pressure and weld contacts are permanently sealed in an environmentally resistant containment Water, salt, and similar materials cannot enter the sealed volume to break down the electrical connection. A potting material 60 may then be added in the connector receptacle 58 to seal between the connector ends 46 and the connector receptacle 58.

In the preferred embodiment, the foot of the preferred free wall is positioned adjacent the right angle corner formed in the lugs 38. When a wire end connector is then pressed over the connector ends 46, the foot of the free wall resists inward motion of the lugs 38, thereby helping to preserve the pressure contact 42, the welded contact 44 and the seal made between the exterior connector ends 46 and the potting material 60, if any. Similarly, the preferred lug wall 34 extends to the lug corner on the opposite side from the base of the free wall. When a wire end connector is then withdrawn from the connector ends 46, the lug wall 34, braced by the end slots 62, resists motion of the lugs 38, again helping to preserve the pressure contact 42, the welded contact 44 and the seal made between the exterior connector ends 46 and the potting material 60, if any.

In a working example some of the dimensions were approximately as follows: The capsule had a 25.4 millimeter (1.0 inch) diameter, and was about 39.6 millimeters (1.56 inch) long. The leads were about 1.25 millimeters (0.05 inch) in diameter. The holder had a 26.6 millimeter (1.05 inch) diameter, was about 10.0 millimeters (0.4 inch) from the top to the internal diametric wall. From the diametric wall to the emergence point of the leads from the through passages was about 9.6 millimeters (0.38) inch). The windows in the holder formed an opening about 5.0 by 5.5 millimeters, and were about 1.5 millimeters deep. The lower edge was at right angles to the holder axis. The lugs and adjacent lug wall extended about 8.0 millimeters (0.31 inch) farther. The leads extended, exposed about 5.4 millimeters (0.21 inch) along the adjacent lug surfaces. The lugs were flat brass right angles with each leg about 9.2 millimeters (0.36 inch) long. The base had a 35.5 millimeter (1.4 inch) circular, outer diameter adjacent the holder, and a 23.1 millimeter (0.91 inch) height. The inner surface included two, diametrically positioned teeth, complimentary with the holder windows. The upper edges of the teeth were sloped to enhance holder insertion, while the lower edges were perpendicular to the holder axis, to prevent holder withdrawal, once the teeth were snapped in place in the windows. The free wall had a height of about 9.2 millimeters (0.36 inch) with a lip extending perpendicular to the upper end about 1.265 millimeters (0.05 inch) to press the leads against the lugs. The connector receptacle had a 13.5 millimeter (0.53 inch) height. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A vehicle lamp comprising:

a) a capsule having an electrically powered light source, a light transmissive envelope, and a two or more protruding electrical leads, b) a holder having a capsule receptacle to hold the capsule, and lug supports to assist in lug support, c) two or more connection lugs, at least one having a first coupling end supported in part by the holder, at least one contact point making a contact with one of the leads and an exposed connector end, and d) a base formed from a slightly flexible material coupled to the holder including a portion formed as a pressure arm pressing at least one lead against the at least one adjacent lug to preserve electrical contact between the lead and the lug.

2. The lamp in claim 1, wherein the light source is an incandescent light source.

3. The lamp in claim 1, wherein the holder includes a lug wall extending adjacent the lugs in the region where electrical contact is made between the lead and the lug.

4. The lamp in claim 3, wherein the lug wall extends adjacent the lugs on a side opposite where the electrical contact is made between the lead and the lug.

5. The lamp in claim 3, wherein the lug wall includes a lug wall passage adjacent where a weld contact is made between the lead and the lug.

6. The lamp in claim 1, wherein at least one lug includes an end coupled to the holder.

7. The lamp in claim 1, wherein at least one lug includes a right angle dividing the lug into a first side and a second side.

8. The lamp in claim 7, wherein the at least one lug including a right angle includes a side coupled to the base.

9. The lamp in claim 7, wherein the at least one lug including a right angle includes a side coupled to the base by potting material.

10. The lamp in claim 1, wherein the pressure arm includes a lip to press the lead and lug into contact with each other.

11. The lamp in claim 1, wherein the pressure arm comprises a wall with a free end closely positioned adjacent the lead and lug to provide a pressure contact between the lead and lug.

12. The lamp in claim 1, wherein the base includes a coupling face to mate with a corresponding coupling face of the holder to provide a coupling between the holder and base.

13. The lamp in claim 12, wherein the base includes a protruding element to clip into an indentation formed in the holder.

14. The lamp in claim 12, wherein lug includes a right angle with one leg of the right angle projecting outwards to the connector ends, and the base includes a blocking element positioned adjacent the right angle to block inward motion of the connector ends.

15. The lamp in claim 12, wherein lug wall includes end portions positioned adjacent the base, and the base include walls adjacent the lug wall end portions to block motion of the lug wall end portions when force is applied axially to the connector ends.

16. A vehicle lamp comprising:

a) a capsule having an electrically powered light source, a light transmissive envelope with a seal end, and a two or more protruding electrical leads, b) a holder having a capsule receptacle to hold the capsule along the seal end, a holder coupling surface, and a lug coupling, c) two or more connection lugs having a first coupling end to couple with the holder, at least one lug having a contact point making a contact with one of the leads and an exposed connector end, and d) a base formed from a slightly flexible material having a base coupling surface coupled to the holder along the holder coupling surface, a portion formed as a pressure arm preserving at least one lead in contact with the adjacent lug, and a connector receptacle partially enclosing the connector ends.

17. A vehicle lamp comprising:

a) a capsule having an electrically powered light source, a light transmissive envelope with a seal end, and a two or more protruding electrical leads, b) a holder having a capsule receptacle to hold the capsule along the seal end, a holder coupling surface, and a lug coupling, c) two or more connection lugs each having a first coupling end to couple with the holder, a pressure contact point to make the pressure contact with a respective lead, and a weld point to make a weld contact with the same respective lead, and a connector end, and d) a base formed from a slightly flexible material having a base coupling surface coupled to the holder along the holder coupling surface, a portion formed as a pressure arm forcing the respective leads to contact with adjacent the pressure contact points of the respective lugs, and a connector receptacle partially enclosing the connector ends.

* * * * *